United States Patent [19]

Rourick-Hamczyk

[11] Patent Number: 4,913,149

[45] Date of Patent: Apr. 3, 1990

[54] MANIPULATABLE FABRIC

[76] Inventor: Margaret D. Rourick-Hamczyk, 342 E. 85th St., New York, N.Y. 10028

[21] Appl. No.: 228,703

[22] Filed: Aug. 5, 1988

Related U.S. Application Data

[63] Continuation of Ser. No. 4,865, Jan. 20, 1987, abandoned.

[51] Int. Cl.[4] ..... A63H 33/00

[52] U.S. Cl. ..... 446/486

[58] Field of Search ..... 446/486, 119; 5/482, 5/486, 497, 490, 491

[56] References Cited

U.S. PATENT DOCUMENTS

| | | | |
|---|---|---|---|
| 2,628,046 | 2/1953 | Hart | 5/482 |
| 2,825,178 | 3/1958 | Hawkins | 446/119 |
| 3,222,072 | 12/1965 | Dreyer | 446/119 |
| 3,745,694 | 7/1973 | Vennola | 446/119 |
| 3,882,559 | 5/1975 | Kano | 5/482 |
| 4,305,582 | 12/1981 | Barton | 446/486 |

FOREIGN PATENT DOCUMENTS

| | | | |
|---|---|---|---|
| 1179696 | 12/1958 | France | 446/119 |
| 2368976 | 5/1978 | France | 446/486 |

*Primary Examiner*—Robert A. Hafer
*Assistant Examiner*—Michael Brown

[57] ABSTRACT

An elastic fabric having a plurality of block shaped members interconnected by elastic thread, the members having flattened abutting surfaces and abut one another in side by side relationship and face one another in close end to end relationship being separated at the ends by elastic thread, the members being arranged in interconnected rows, each member having an axial channel for receiving thread, the members in each row being disposed so that the thread channels are arranged parallel to one another with the elastic being woven through a channel and along the end of one member and its adjoining member to the channel to the adjoining member and so on to hold the assemblage to a cohesive readily yieldable whole, and assemblage being foldable into a variety of shapes.

2 Claims, 1 Drawing Sheet

MANIPULATABLE FABRIC

This is a continuation of application Ser. No. 07/004,865 filed Jan. 20, 1987. Now abandon.

It is requested that the drawing in that case be transferred to this application.

This invention relates to a new and interesting fabric and more particularly to a fabric having many and varied uses especially with reference to a child's plaything or a psychic pacifier.

BRIEF SUMMARY OF THE INVENTION

It has long been recognized that people have an inborn need to manipulate or twiddle with their hands and fingers. Apparently, for reasons not quite understood, such manipulation is soothing to the psyche. Thus we have rosaries, tassels extending from prayer shawls, worry beads and like articles.

Children in particular are fascinated by small objects which can be manipulated, especially if multicolored and manually transformable in one respect or other. Such devices make excellent tools for teaching children basic skills such as counting, manual dexterity, etc.

While heretofore proposals have been set forth for creating such a fabric, such have been deficient in one respect or another and thus a really successful device of this nature has yet to be provided. For example in French Pat. No. 1,179,696 issued to Bernadette Denis on Dec. 22, 1958 the fabric disclosed therein is not fully manipulatable because the beads making up the fabric tightly abut each other on all sides.

OBJECTS OF THE INVENTION

It is thus a primary object of the present invention to provide a beaded fabric which can be manually manipulated in a pleasing fashion.

It is another important object of the present invention to provide an instructional plaything for children.

It is still another important object of the present invention to provide a flexible beaded material for the creation and variation of logos, alphabets, numbers, geometric shapes, pictures and abstract art designs.

It is yet another important object of the present invention to provide a "beaded" elastic fabric which is fully manipulatable.

These and other objects will be realized by an elastic fabric comprising a plurality of block shaped members interconnected by elastic thread, said members having flattened abutting surfaces and abut one another in side by side relationship and face one another in close end to end relationship being separated at the ends by elastic thread, said members being arranged in interconnected rows, each member having an axial channel for receiving thread, the members in each row being disposed so that the thread channels are arranged parallel to one another with the elastic being woven through a channel and along the end of one member and its adjoining member to the channel of the adjoining member and so on to hold the assemblage in a cohesive readily yieldable whole, said assemblage being foldable into a variety of shapes.

Other objects and advantages of the present invention will become apparent from a reading of the following specification taken in connection with the accompany drawing wherein:

DETAILED DESCRIPTION OF THE VIEWS OF THE DRAWING

Figure 1:
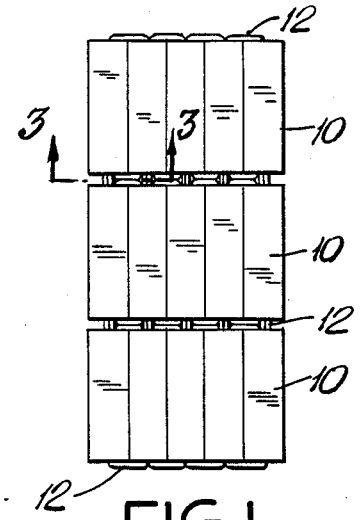
FIG. 1 is a plan view of a portion of an embodiment of the fabric of the present invention in a relaxed state.

Referring now to the drawing wherein an embodiment of fabric in accordance with the present invention is shown, numeral 10 indicates one of the many beads making up the fabric and numeral 12 indicates the thread which unites the beads in a tightly knit unitary whole. Thread 12 is stretchable to give an elastic quality to the fabric. The thread is directed longitudinally and laterally to unite the beads into a fabric. The lateral weave may be best seen in FIGS. 3 and 4 where the fabric is shown in a relaxed and stretched state, respectively.

Figure 2:
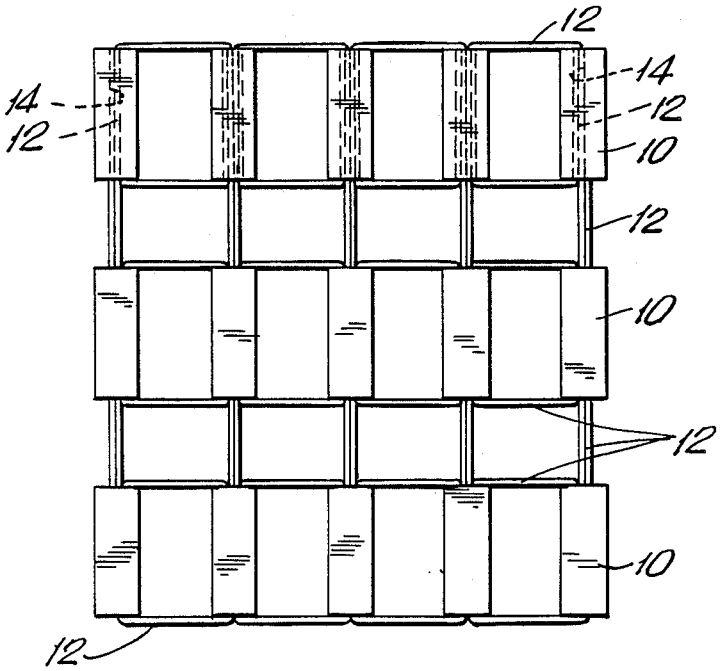
FIG. 2 shows the embodiment of FIG. 1 in the stretched state.

FIGS. 1 and 2 the fabric is also shown in a relaxed and stretched state. The abutting side by side relationship of the pieces may be best seen in the FIGS. 1 and 3. It will be realized that the pieces actually fully abut at their sides and not at their ends where they are held somewhat apart by the thread. By virtue of not abutting on a all four sides the fabric is readily manipulated, i.e., individual beads or groups of beads may be turned or otherwise varied.

Figure 3:
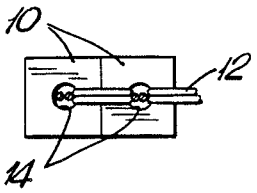
FIG. 3 is a sectional view taken on line 3—3 of FIG. 1.
Figure 4:
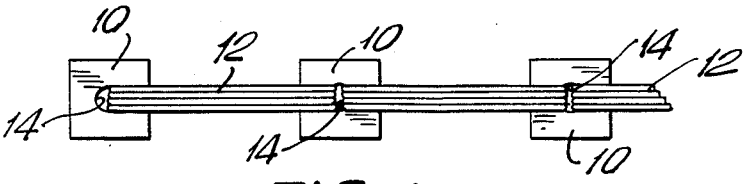
FIG. 4 is an end view of the embodiment of FIG. 2.

As may be seen in FIGS. 3 and 4, bead 10 is block shaped being rectangular in section. Thus each bead present two distinct ends and four distinct sides. The beads may be cubic, i.e., the sides and ends being of the same size, or the sides may be longer or shorter than the ends depending upon the effect that is desired. What is important however is that the beads are block shaped, i.e., rectangular in section.

Adjacent beads abut each other in side by side relationship and face one another in close end to end relationship when pulled taut by the weave. A longitudinal channel 14 is formed in each bead to accommodate thread 12 which holds the assemblage together. It will be noted that the thread is woven through a channel and along the end of one bead and its adjoining bead to the channel of the adjoining bead then through the channel to the other end of the bead to the next adjacent bead upon reaching the end of one row of beads the thread is then reversed and woven through the channels of the same row of beads and then passed through the next adjacent row of beads and so on to hold the assemblage in cohesive readily yieldable whole. The weave is ended by knotting the thread, the knot being positioned in the terminal thread channel 12 or positioned at the end of the terminal bead. In the first instance the knot may be clamped in the thread channel and in the second the knot must be larger than the thread channel.

It will be realized that individual beads may be rotated on the thread passing the its longitudinal channel. Thus if the beads are multicolored different designs in the fabric may be fashioned by rotating individual beads to give the fabric an interesting and pleasing quality. It should be realized that in addition to colors, numbers, letters and geometric shapes, amongst other things, may be carried by and formed with the beads.

It should be realized that the embodiment herein described is only representative of the invention and it is not intended to limit the invention to this particular embodiment as the invention encompasses all embodiments falling within the spirit and scope of the appended claims.

I claim:

1. An manipulatable fabric comprising a plurality of block shaped members interconnected by elastic thread, said members having flattened abutting surfaces and abut one another in side by side relationship and face on another in close end to end relationship being separated at the ends by elastic thread, said members being arranged interconnected rows, each member having an axial channel for receiving thread, the members in each row being disposed so that the thread channels are arranged parallel to one another with the elastic being woven through a channel and along the end of one member and its adjoining member to the channel of the adjoining member and so on to hold the assemblage in a cohesive readily manipulatable whole, said assemblage being foldable into a variety of shapes.

2. An manipulatable fabric comprising a plurality of block shaped members interconnected by elastic thread, said members having flattened abutting surfaces and abut one another in side by side relationship and face one another in close end to end relationship, being separated at the ends by elastic thread, said members being arranged in interconnected rows, each member having an axial channel for receiving thread, the members in each row being disposed so that the thread channels are arranged parallel to one another with the elastic being woven through a channel and along the end of one member and its adjoining member to the channel of the adjoining member and then through the channel to the other end of the member to the next adjacent member and so on to hold the assemblage in a cohesive readily yieldable whole, said assemblage being foldable into a variety of shapes.

* * * * *